United States Patent [19]

Garcia

[11] Patent Number: 4,501,330

[45] Date of Patent: Feb. 26, 1985

[54] WELL COMPLETION APPARATUS AND METHOD

[75] Inventor: Juan A. Garcia, Kingwood, Tex.

[73] Assignee: Exxon Production Research Co., Houston, Tex.

[21] Appl. No.: 576,827

[22] Filed: Feb. 3, 1984

[51] Int. Cl.[3] ..... E21B 43/11

[52] U.S. Cl. ..... 166/297; 166/285

[58] Field of Search ..... 166/297, 369, 382, 381, 166/387, 285, 291, 115

[56] References Cited

U.S. PATENT DOCUMENTS

| | | | |
|---|---|---|---|
| 2,852,078 | 9/1958 | Krause, Jr. | 166/285 |
| 3,097,691 | 7/1963 | Smith | 166/291 |
| 3,531,236 | 9/1970 | Braddick et al. | 166/285 |

*Primary Examiner*—Stephen J. Novosad
*Assistant Examiner*—Thuy M. Bui
*Attorney, Agent, or Firm*—John S. Schneider

[57] ABSTRACT

A production casing string is composed of an upper section and a smaller diameter lower section. The lower portion of the upper section forms upper and lower polished bore receptacles. The upper receptacle has an internal bore of larger diameter than the bore of the lower receptacle. A first annular shoulder is formed at the junction of the bores. A support shoulder is formed in the lower receptacle at the junction of the bore of the lower receptacle and the inner wall of the lower section. A hanger seat member is positioned on the support shoulder. An outer tubing string positioned in the production casing string has a reduced diameter stinger section provided with an annular external seal unit which sealingly engages the bore wall of the lower receptacle. A second annular shoulder is formed on the outer wall of the outer tubing string at the junction of the outer walls of the outer tubing string and the stinger section. When the outer tubing string is positioned in the production casing string, the lower end of the stinger section is spaced a selected distance above the hanger seat member and the second annular shoulder is spaced a selected distance above the first annular shoulder. A third annular shoulder is formed in the outer tubing string at the junction of the inner walls of the outer tubing string and the stinger section. An inner tubing string, provided with upper and lower spaced-apart outer fluted hangers, extends through the outer tubing string into the production casing string. The inner tubing string is positioned such that the lower fluted hanger seats on the hanger seat member and the upper fluted hanger is spaced a selected distance above the third annular shoulder.

11 Claims, 12 Drawing Figures

14 & 11
2
4
14
7
12
4a
9a
7a
9
13a
8a
8
7e
14
13
8c
10
4c
12a
4b
7b
7c
11
7d
6b
6a
6
5a
5
6
3
11
6
15
9a
9
15c
8a
15b
15a
15d
15e
8
10
14
11a
7b
7c
11
7d
6b
6a
6
5a
4b
5
12
15
14
4a
13a
15a
15e
7e
14
13
10
11
12a
7b
7c
7d
6b
4b
6
5a
11
5
6
3
11
6
16a
14
9a
11
9
7a
8a
15a
15e
8
10
4c
11
7b
7c
7d
6a
4b
5a
5
6
16a
17
16
3
11
6
12
14
9a
20
9
13a
15c
8a
15b
15a
15e
13
10
7b
12b
7c
6b
20
6
11
5a
4b
20
5
12b
17
3a
3
3a
11
6

FIG. 9.
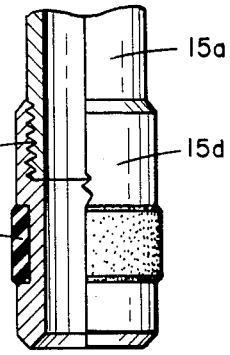
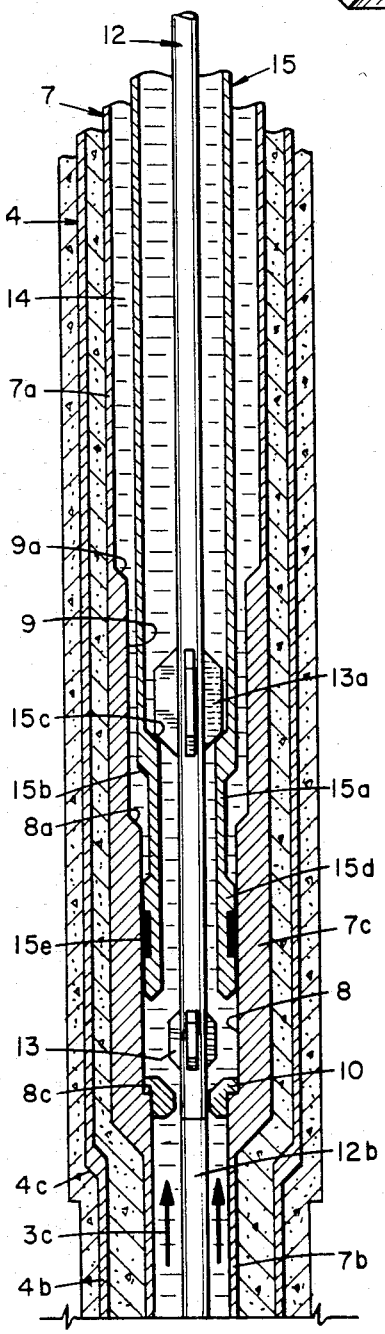
FIG. 6.
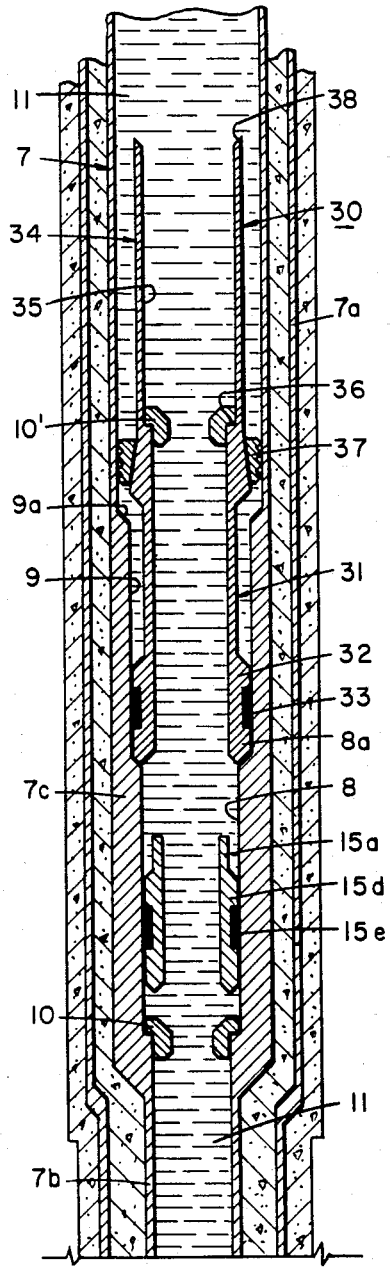
FIG. 7.
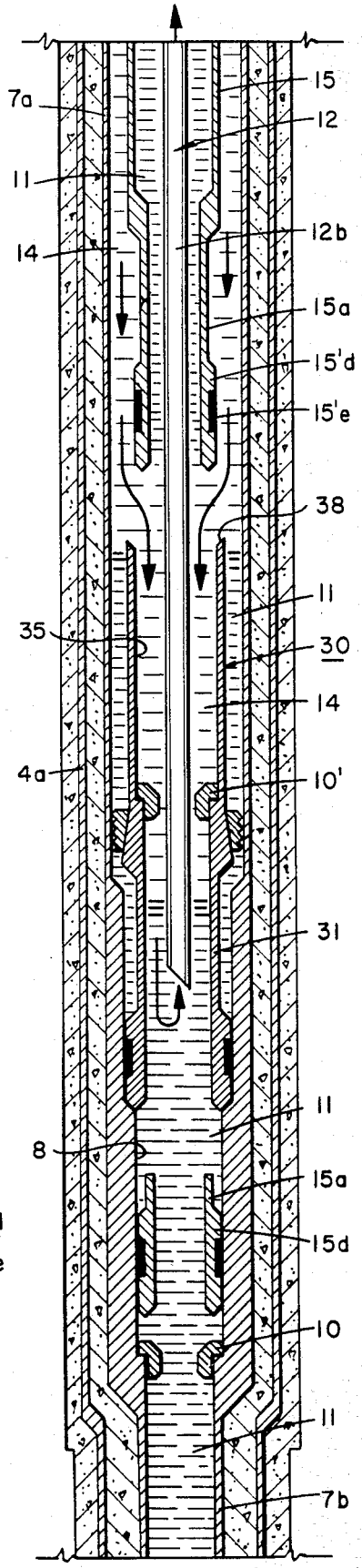
FIG. 8.

WELL COMPLETION APPARATUS AND METHOD

BACKGROUND OF THE INVENTION

The present invention relates to apparatus and method for completing high-pressure wells with large bore stingers while providing limited, controlled movement of the seals during large pressure, temperature and density changes.

One of the problems in completing high-pressure wells with a floating seal type completion is that the production tubing string can expand or contract and move under various well conditions. This movement can cause the tubing string to buckle and/or pull out of the seal receptable used in floating type completions. If the well is completed using a latch type completion to prevent movement, then certain conditions such as stimulating the well can cause the string to part as cooling and pressure attempt to contract the string. This invention overcomes the problem mentioned above by controlling movement of the production pipe string in high pressure wells in a manner that controls buckling and loads.

This completion technique also restricts movement of the seals during production of the well. Further, it provides for a back-up system in the event damage occurs within the lowermost polished bore receptacle or the seal section. In addition, the technique takes into account the possibility of the seals seizing within the polished bore receptacle. If the seal should seize in the down position during the production period, the completion design is such that shutting in of the well will not result in parting of the production tubing string. Also if damage should occur to the lowermost polished bore receptacle. The design allows for the use of a replacement section. This section is run on tubing and is located within the uppermost polished bore receptacle. Downward setting of weight forces slips to set on the inside diameter of the lowermost section of a larger diameter tieback string. The placement of this section provides a new polished/honed section above and within the lower section of the tieback which can then be used to once again accept the production tubing stinger and circulating string.

This method allows the limited controlled movement of sealed sections under extremely high pressure and high density changes in well completions. In addition, this completion procedure also prohibits movement of the critical sealing elements during production times and reduces seal wear during producing periods. The most important aspect of this completion is that use of this flexible system can reduce completion costs and provide a completion technique that allows the use of lower strength steels by allowing controlled movement of the strings to allow for drastic variations in pressures, temperatures and densities for deep hot wells.

SUMMARY OF THE INVENTION

This invention concerns apparatus for completing a well in which a well bore is drilled from the earth's surface through a high pressure formation and is provided with a protective casing string extending from the earth's surface to a selected depth in the well bore. A production casing string extends from the earth's surface through the protective casing string and includes upper and lower sections, the lower section being of smaller diameter than the upper section and extending to total depth of the well bore. The lower portion of the upper section is stepped to provide upper and lower polished receptacles, the upper receptacle having an internal bore larger in diameter than the bore of the lower receptacle forming a first annular shoulder at the junction of the receptacle bores. A support shoulder is formed in the lower receptacle at the junction of the bore of the lower receptacle and the inner wall of the lower section. A ring-shaped hanger seat member is positioned on the support shoulder. An outer tubing string is positioned in the production casing string and contains a reduced-diameter stinger section. The stinger section is provided with an annular external seal unit which sealingly engages the bore wall of the lower receptacle. A second annular shoulder having a larger diameter than the lower receptacle bore is formed on the outer wall of the outer tubing string at the junction of the outer wall of the outer tubing string and the stinger section. When the outer tubing string is positioned in the production casing string, the lower end of the stinger section is spaced a selected distance above the hanger seat member and the second annular shoulder is spaced a selected distance above the first annular shoulder. A third annular shoulder is formed in the outer tubing string at the junction of the inner walls of the outer tubing string and the stinger section. An inner tubing string provided with upper and lower spaced-apart outer fluted hangers extends from the earth's surface through the outer tubing string into the production casing string. The inner tubing string is smaller in diameter than the inner diameter of the hanger seat member and allows fluid flow therebetween. The inner tubing string is positioned such that the lower fluted hanger seats on the hanger seat member and the upper fluted hanger is spaced a selected distance above the third annular shoulder.

The well-completion method invention involves positioning the production casing string through the protective casing string so that it extends from the earth's surface to total depth of the well bore. The production casing string is cemented in place in the well bore by displacing a cement slurry from the production casing string with drilling mud. The inner tubing string is run into the production casing string and through the hanger seat member and the lower fluted hanger is seated on the hanger seat member. A packer fluid is circulated down the production casing string and up the inner tubing string to remove the drilling mud from the production casing string to a level below the hanger seat member so that the production casing string above that level is full of packer fluid. The inner tubing string is removed from the well and the outer tubing string is run into the production string. The outer tubing string is positioned in the production casing string so that the seal unit on the stinger section sealingly engages the bore wall of the lower receptacle and the lower end of the stinger section is spaced a selected distance above the hanger seat member and the second annular shoulder is spaced a selected distance above the first annular shoulder. The inner tubing string is run into the outer tubing string and the lower fluted hanger is seated on the hanger seat member. Drilling mud is circulated down the outer tubing string and up the inner tubing string to replace the packer fluid in the outer tubing string with the drilling mud. The inner tubing string is removed from the well. A perforator gun is lowered on a wire line into the production casing string to adjacent a high pressure formation and the perforator gun is actuated to perforate the production casing string and the formation. The perforator gun is removed from the well. A longer inner tubing string is run into the well and the lower fluted hanger is seated on the hanger seat member. The lower end of the longer inner tubing string extends in the production casing string to a level below the perforated formation. The upper fluted hanger is spaced a selected distance above the third annular shoulder. A wash fluid is circulated down the outer tubing string and up the inner tubing string to remove the drilling mud from the well to reduce the hydrostatic pressure in the well such that fluids from the formation can flow into the production string. Circulation is continued until only wash fluid and formation fluids appear at the surface. The formation fluids are produced through the inner tubing string.

If the seal unit should seize in the lower receptacle, such that it cannot be removed, heavy mud is circulated into the outer tubing string and up the inner tubing string to offset the formation pressure. The inner tubing string is removed from the well and the outer tubing string is rotated to release the stinger section from the seized seal unit. The outer tubing string can then be removed from the well and a new seal unit is connected forming the stinger. Since the first stinger assembly was left in the well blocking the lower polished bone receptacle, a backup polished bore receptacle unit must be run into the production casing string to accept the new seal unit. This backup polished bore receptacle unit is run on a work string. The backup receptacle comprising an upper receptacle sleeve section and a lower tubular section, provided on its lower periphery with an external annular seal unit, the bore of the tubular section being of smaller diameter than the bore of the upper sleeve section forming a backup shoulder at their junction. A backup ring-shaped hanger seat member is positioned on the backup shoulder, the bore of the receptacle sleeve being of the same diameter as the lower receptacle and a latch slip assembly is provided about the exterior of the backup receptacle unit. The backup receptacle unit is positioned in the production casing such that the backup seal unit seats on the first annular shoulder in the upper receptacle and sealingly engages the bore wall of the upper receptacle. The receptacle sleeve section extends above the upper receptacle. The backup receptacle is latched in position and the outer tubing string and stinger section provided with the new seal unit are lowered into the production casing string. The lower end of the stinger section is positioned just above the upper end of the backup receptacle sleeve to allow circulation and removal of the mud from between this outer tubing-casing annulus. The inner tubing string is run through the second tubing string and into the receptacle unit to a level such that its lower end is positioned below the backup hanger seat member. Packer fluid is circulated down the outer tubing string casing annulus and up the inner tubing string to remove mud to the level below the backup hanger seat. The outer tubing string is lowered and the new seal unit is positioned in the bore of the receptacle sleeve. The inner tubing string is lowered so as to seat the lower fluted hanger on the backup hanger seat and the upper fluted hanger is spaced a selected distance above the third annular shoulder. A wash fluid is circulated down around the inner tubing string and up the inner tubing string to remove mud from the production casing string and the outer tubing string. Formation fluids are then produced through the inner tubing string.

BRIEF DESCRIPTION OF THE DRAWINGS

FIGS. 1 through 6 are stepwise illustrations of a well completion in accordance with the present invention;

FIGS. 7 and 8 are sectional views showing installation of a backup polished bore receptacle unit;

FIG. 9 is a fragmentary sectional view of the seal unit of the invention;

DESCRIPTION OF THE PREFERRED EMBODIMENTS

Figures 1, 2, 3, 4, 5:
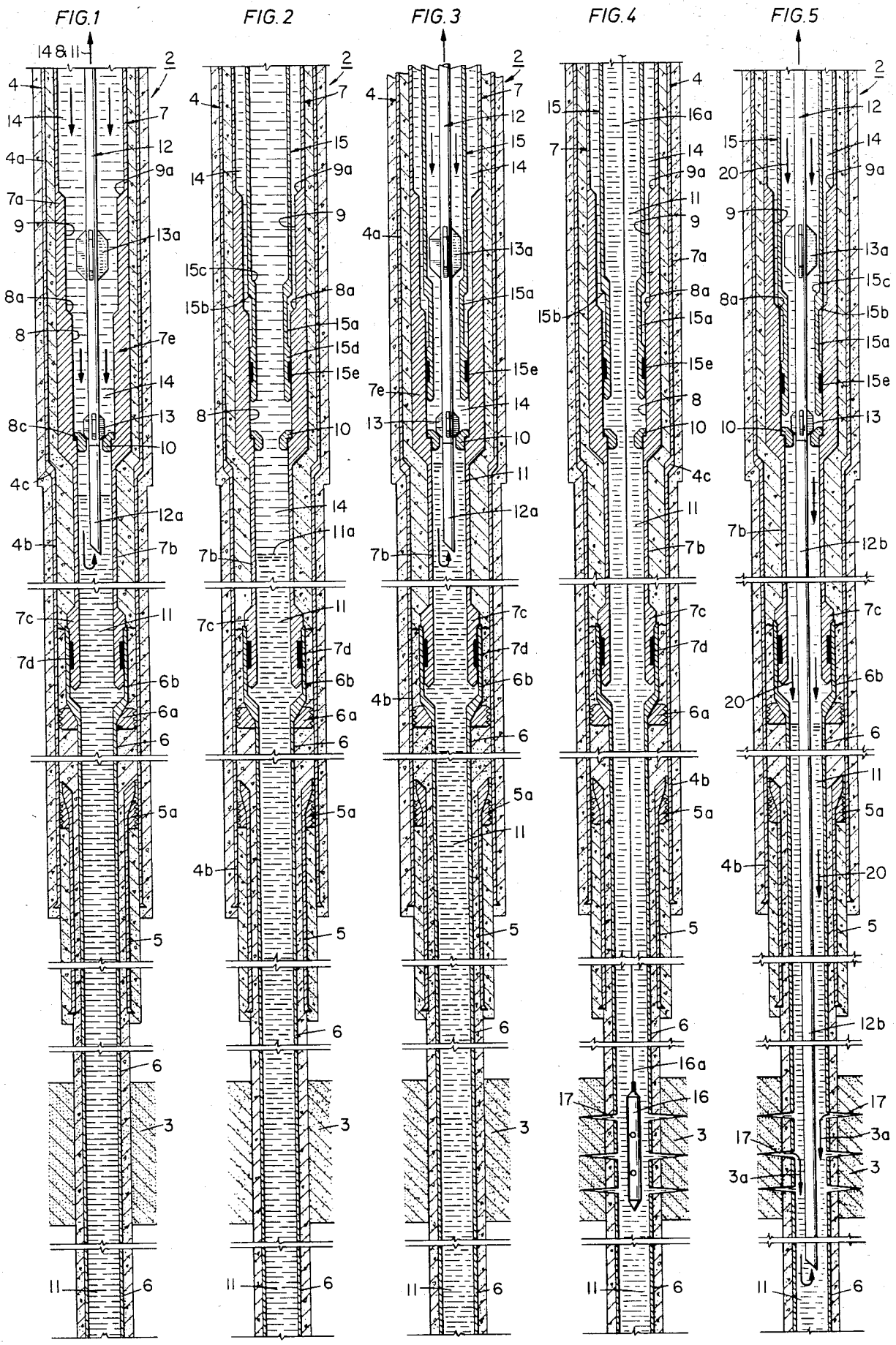
Figure 10:
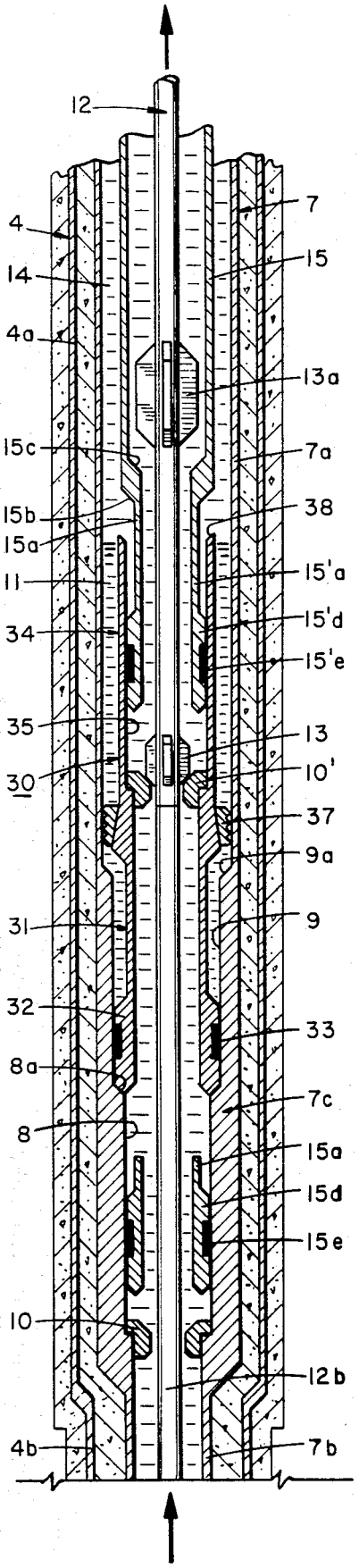
FIG. 10 shows the well producing with the backup unit in position.

Referring to FIGS. 1 through 6, a well bore, generally designated 2, extends from the earth's surface and penetrates a plurality of earth formations including a high-pressure gas formation 3. A protection casing string 4, comprising an upper section 4*a* and a reduced-diameter lower section 4*b* joined together as at 4*c*, extends to a predetermined depth and is cemented in position in the well bore, as shown. A protective liner casing 5 is hung-off in the lower end of casing string 4 by a hanger slip assembly 5*a* and cemented in position. A production casing string 6 is hung-off in the lower section of casing string 4*b*, above the top of protective liner casing 5 by a hanger-slip assembly 6*a* and cemented in position. The lower end of casing string 6 extends through high-pressure gas formation 3 to the total depth of well bore 2. The upper end of production casing 6 forms an enlarged diameter tieback receptacle sleeve 6*b*.

A production tieback casing string 7 is run into the well bore and comprises an upper section 7*a* and a reduced diameter lower section 7*b*. The latter forms a stinger which is enlarged at its lower end to form seal section 7*c* which contains an annular external seal ring 7*d*. Tieback string 7 is lowered into the well until seal section 7*c* is positioned just above the upper end of tieback receptacle sleeve 6*b*. Cement is then pumped down through production tieback string 7 and displaced up the annulus between protective casing string 4 and production tieback string 7 to form a cement sheath therebetween. Tieback string 7 is then lowered to stab seal section 7*c* into tieback receptacle sleeve 6*b*. Seal section 7*c* bottoms out on the top end of receptacle sleeve 6*b* and weight is slacked off on tieback casing string 7 and the cement is allowed to set. Production tieback casing string 7 and production casing 6 together form a continuous production casing string extending from the earth's surface to the total depth of well bore 2. The junction of casing sections 7*a* and 7*b* is positioned just above the connection 4*c* of protective casing string 4.

The lower portion 7*e* of casing section 7*a* of tieback casing string 7 is thick-walled and internally stepped and forms a lower polished bore receptacle 8 and an upper polished bore receptacle 9 which are interconnected and concentric. The junction of the bore walls of receptacle 8 and receptacle 9 forms a first upwardly facing annular shoulder 8*a*. The junction of the bore wall of receptacle 9 and the inner wall of casing 7*a* forms an upwardly facing annular shoulder 9*a*. The lower end of the bore wall of receptacle 8 forms an upwardly facing annular support shoulder 8*c* at its junction with the inner wall of stinger section 7*b*. Lower receptacle 8 has a smaller internal diameter than the internal diameter of receptacle 9. After the tieback string has been cemented in the plugs are drilled out and the tieback connection is tested. A ring-shaped hanger seat member 10 is positioned in the lower end of receptacle 8 and is supported on annular support shoulder 8*c*. Hanger seat member 10 may be run in and located by a wire line tool or may be run on a tubing work string to which it may be shear pinned.

The well is now in condition to initiate the completion operation. The inside of production string 6 and production tieback casing 7 are full of heavy mud 11. The completion procedure is designed to use a light-weight packer fluid, e.g., water or oil, left behind a tubing string which is to be run in and stabbed into the bore of lower receptacle 8 as shown in FIG. 2. It is necessary to remove all of the heavy mud 11 to a level just below hanger seat member 10. This is accomplished by running an inner tubing string 12 into tieback casing string 7 to below hanger seat 10. A fluted hanger 13 is connected to inner tubing string 12 near its lower end to seat on hanger seat 10. The flutes of hanger 13 support tubing string 12 and allow fluid flow between tubing string 12 and the inner wall of hanger seat 10. As shown in the figures, lower end 12*a* of tubing string 12 below fluted hanger 13 extends a selected distance below hanger seat 10. Tubing string 12 is also provided with a second fluted hanger 13*a* which is positioned a predetermined distance above fluted hanger 13. The purpose of fluted hanger 13*a* will be described later herein. As shown by the arrows in FIG. 1, a packer fluid 14 is circulated down the annulus around inner tubing string 12 and up outer tubing string 12 to wash out heavy mud 11. However, this circulating flow pattern may be reversed. Circulation is maintained until returns at the surface show clean packer fluid which indicates that heavy mud 11 has been removed to a level 11*a* as seen in FIG. 2. The entire length of tieback casing string 7 above mud level 11*a* is now full of clean packer fluid 14. Tubing string 12 is removed to the surface.

An outer string 15 is run into tieback casing string 7 as shown in FIG. 2. The lower end of outer tubing string 15 is provided with a reduced diameter stringer section 15*a* which forms a second annular external shoulder 15*b* at its junction with the larger diameter tubing. An internal upwardly facing third annular shoulder 15*c* is formed in tubing string 15 just above second shoulder 15*b*. The lower end of stinger section 15*a* is enlarged externally to form a seal unit 15*d* provided with an external annular seal ring 15*e*. Tubing string 15 is lowered into tieback string 7 and stinger seal unit 15*d*, together with seal ring 15*e*, is stabbed into lower receptacle 8 and lowered until second annular shoulder 15*b* abuts first annular shoulder 8*a* at the top of receptacle 8. This indicates to the operator that tubing string 15 is in its full down position. In this position, the lower end of stinger section 15*a* is located above hanger seat 10. Placement of tubing string 15 (or space out) can be made and referenced from this point. Tubing string 15 is then raised a selected distance which may vary in accordance with the particular operation as governed by temperature and pressure effects during the life of the well. Tubing string 15 is hung-off at the surface and seal ring 15*e* sealingly engages the bore wall of lower receptacle 8. The next step is to perforate production casing 6 and high-pressure formation 3. However, since tubing string 15 and a portion of casing 7 below tubing string 15 contains light-weight packer fluid 14 at this time, it is necessary to first run tubing string 12 back into the well in order to replace the packer fluid with heavy mud, as shown in FIG. 3, to offset the high pressure of formation 3 when casing 6 and formation 3 are perforated. Such procedure avoids "snubbing in" of tubing string 12 after perforating. After outer tubing string 15 is again filled with heavy mud 11, tubing string 12 is removed from the well. A perforator gun 16 is then lowered into the well on a conductor cable 16*a* and positioned in casing 6 adjacent high pressure formation 3 as shown in FIG. 4. Gun 16 may be a jet-charged gun or a bullet gun or other type perforator. Casing 6 and formation 3 are perforated as at 17. Perforator gun 16 is then removed from the well.

Inner tubing string 12 is rerun into the well and fluted hanger 13 is again seated on hanger seat 10. Section 12*b* of tubing string 12 below hanger 13 extends down into production casing string 6 to a depth below the level of perforated high pressure formation 3. As shown in FIGS. 3 and 5, fluted hanger 13*a* is positioned on inner tubing string 12 so that when fluted hanger 13 is seated on hanger seat 10, the lower end of fluted hanger 13*a* is spaced a predetermined distance above third annular shoulder 15*c* in outer tubing string 15. As shown in FIG. 5, a wash fluid is now pumped down the annulus surrounding inner tubing string 12 and up tubing string 12 as indicated by arrows 20 to remove heavy mud 11 from the well. As this circulation progresses and more heavy mud is removed, the hydrostatic pressure of the mud column which originally offset the fluid pressure of formation 3 after perforation is reduced enough to permit formation fluid to flow into production casing 6 and into the lower end of inner tubing string 12 as indicated by the arrows 3*a*. The circulating procedure, plus high-temperature fluid from formation 3, causes an increase in temperature in the well which causes tubing string 12 and tubing 15 to expand and elongate. Since both tubing strings are fixed (hung-off at the surface), they tend to move downwardly due to expansion. Downward movement of inner tubing string 12 is prohibited by contact of fluted hanger 13 with hanger seat 10. This causes a compressive loading of tubing string 12 which in turn causes bends or doglegs in the string. But, such bends are within acceptable limits. Outer tubing string 15 is affected in the same manner but it can only move down until second annular shoulder 15*b* contacts first annular shoulder 8*a* at the upper end of the bore wall of lower receptacle 8. This also causes compressive loading and bending of tubing string 15 but such bending is also within acceptable limits. This is partially controlled by the predetermined setting position of the shoulder above this seal selected at the time the tubing was spaced out. During the cleanout or circulating period, tubing string 12 produces a mixture of wash fluid, mud and gas. The process is continued until it is determined that all of the mud has been removed. The well fluids from formation 3 are then produced through inner tubing string 12. Well treating fluids such as corrosion inhibitors may be injected and circulated down the annulus between tubing string 12 and tubing string 15 and be produced along with the formation fluids.

When the well is shut-in for various reasons, such as for workover operations, an increase of bottom hole pressure occurs as indicated by the arrows 3*c* in FIG. 6.

This pressure is higher than that which existed during the initial completion and during production of the well. This increase in pressure coupled with a cooling effect due to shutting in of production causes outer tubing string 15 to contract and move in an upward direction. The cooling effect, plus the high bottom hole pressure acting across the cross-sectional area of seal 15*d* on stinger 15*a*, literally tries to move seal unit 15*d* upwardly out of receptacle 8. As outer tubing string 15 moves up, the third annular shoulder 15*c* in tubing string 15 engages the second fluted hanger 13*a* on inner tubing string 12. As this engagement occurs, the weight of tubing string 12 is transferred to tubing string 15. As shown in FIG. 6, as the outer tubing moves up the fluted hanger 13 is raised off hanger seat 10. This transfer of load accomplishes three objectives. First, it restricts upward movement of seal unit 15*d* by adding weight at the stinger; second, it reduces the bending or doglegs severity of tubing string 15; and third, the upward movement of tubing string 15 reduces tensile loading at the top of the tubing string by lifting weight beyond what was set on hanger seat 10 initially. This entire operation results in controlled movement, loads, and buckling of the completion. These controls are not possible with either the conventional latch or floating type completion procedural known heretofore.

The completion technique also provides a backup procedure in the event seal unit 15*d* is seized in bore receptacle 8 when, for example, it may be required to pull the tubing for well services or to workover for any reason. Seal unit 15*d* can not be pulled loose from the receptacle without danger of parting tubing string 15. The first step, however, at the start of such an operation is to "kill the well". Heavy mud is again circulated into the well casing to offset well pressure. Tubing string 12 is removed from the well and a cutting tool run into tubing string 15 on a tubing work string and located in stinger portion 15*a* so as to cut and part seal unit 15*d* from stringer section 15*a* just above the seal unit. The tubing could also be retrieved by right-hand rotation without cutting if a left-handed thread were placed in the upper portion of the same unit. Such an arrangement is shown in FIG. 9. The work string and cutting tool are retrieved to the surface. Tubing string 15 is then removed from the well and seized seal unit 15*d* remains in receptacle 8 as shown in FIG. 7.

A backup polished bore receptacle unit, generally designated 30, is then run on a tubing work string and landed in upper receptacle 8 as shown in FIG. 7. Unit 30 is comprised of a lower tubular section 31 having on its outer lower end a seal unit 32 containing an annular external seal ring 33. The upper section forms a polished bore receptacle 34 having a bore diameter 35 which is the same diameter as the bore diameter of receptacle 8 and approximately the same length. The inside diameter of tubular section 31 is slightly less than that of the inside diameter of bore 35 so as to form an annular internal support shoulder 36 at their junction. As shown, unit 30 is positioned such that seal ring 32 abuts first annular shoulder 8*a* in receptacle 8 and seal ring 33 sealingly engages the bore wall of receptacle 8. Unit 30 is held in place from upward movement by a hanger slip assembly 37, the slip teeth of which bite into the wall of tieback string 7 just above upper receptacle 9. A hanger seat member 10 prime is positioned on annular shoulder 36 and is of the same design and size as hanger seat 10.

After outer tubing 15 has been provided with a new seal unit 15$^1$ *d*, it is again lowered into tieback casing 7 until its lower end is positioned just above upper end 38 of backup polished bore receptacle 34. Inner tubing string 12 is then run into outer tubing string 15 until its lower end extends through the lower end of tubing string 15 and into the bore of backup receptacle unit 30 to a level below hanger seat 10$^1$. A packer fluid 14 is pumped down the annulus behind outer tubing string 15 and up inner tubing string 12 to circulate mud 11 from casing 7 and the bore of receptacle unit 30 to a level below hanger seat 10$^1$. Tubing string 15 remains full of mud due to pressure of the circulating fluid exerted on its lower end. When clean packer fluid appears at the surface, indicating that the desired amount of mud has been removed, outer tubing string 15 is lowered to stab seal unit 15$^1$ *d* into receptacle bore 35 and is lowered until second annular shoulder 15*b* abuts upper end 38 of receptacle 34. Tubing string 15 is referenced from this full down position by raising it a selected distance and hanging off at the surface as in the earlier described operation. Tubing string 12 is now lowered to seat fluted hanger 13 on new hanger seat 10$^1$. Tubing string 12 is also hung-off at the surface and in this position fluted hanger 13*a* is located a selected distance above third annular shoulder 15*c* in outer tubing string 15.

Figure 11:
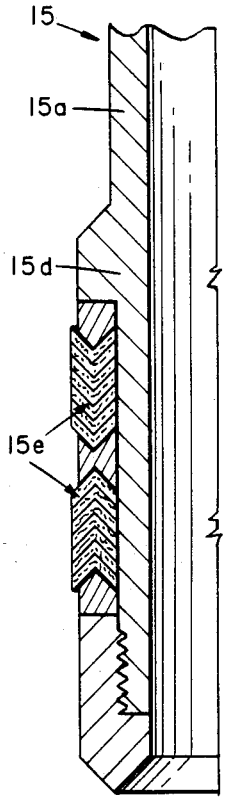
FIG. 11 is a view showing a modification of the seal unit.

To again bring the well into production, wash fluid is pumped down the annulus behind inner tubing string 12 and up tubing string 12 to remove the remainder of mud from the well. As this process continues, the hydrostatic head of the mud is reduced so as to permit fluids from formation 3 to again flow into production casing 6 and be produced through inner tubing string 12 as before. Vertical movement of tubing strings 12 and 15 due to contraction and expansion is restricted as in the earlier described procedure. Although the seal rings are shown schematically, they may be of the chevron type as shown in FIG. 11 and bi-directionally arranged.

Figure 12:
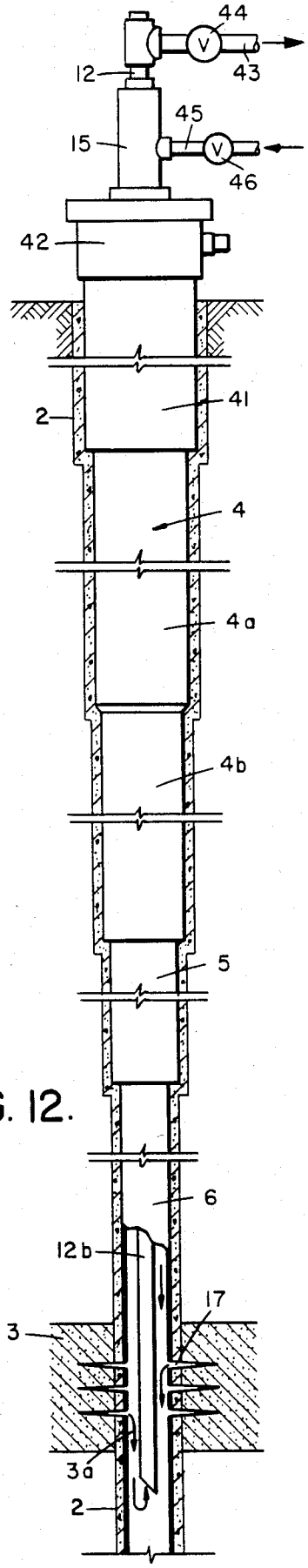
FIG. 12 is an elevational view of the well completed in accordance with the invention.

As shown in FIG. 12, the well is provided with a conventional, cemented in place, surface casing 41 on which is mounted a well head 42. The production casing string, tubing strings 15 and 12, are all hung-off in the well head. Tubing string 15 projects above the well head and extends to a conduit 45 controlled by a valve 46. Tubing string 12 extends through the upper end of tubing string 15 and is connected to a flow line 43 controlled by a valve 44. Well fluids from formation 3 are produced through conduit 43 while treating fluids, such as corrosion inhibitors, can be injected into the well through conduit 45 and be produced along with the well fluids.

The completion method and apparatus of the present invention allows for completion of deep high pressure wells with big bore stingers while at the same time providing controlled movement of the stinger seal unit during high pressure temperature and density changes in the well. The technique also restricts movement of the stinger seal during production periods. This restriction in longitudinal travel greatly reduces seal wear and resulting excessive workover operations. It also allows the pipe strings to breathe, that is, contract and expand, but at the same time restricts their longitudinal movement. The completion technique also provides a backup system in the event damage occurs within the lower polished bore receptacle and the possibility of the seal unit seizing within the receptacle. An important aspect of the invention is the great reduction in completion costs by allowing the use of lower strength standard pipe instead of higher strength special alloy pipes.

Having fully described and illustrated the method and apparatus of this invention, what is claimed is:

1. Apparatus for completing a well in which a well bore is drilled from the earth's surface and is provided with a protective casing string extending from the earth's surface to a selected depth in said well bore, comprising:

a production casing string extending from said earth's surface through said protective casing string;

an outer tubing string positioned in said production casing string and having a reduced-diameter stinger section extending from the lower end of said outer tubing string;

an inner tubing string provided with upper and lower spaced-apart fluted hangers and extending from said earth's surface through said outer string into said production casing string;

said production casing string having upper and lower sections, said lower section being of smaller diameter than said upper section;

the lower portion of said upper section being stepped to provide upper and lower polished bore receptacles;

said stinger section of said outer tubing string being provided with an annular external seal unit which sealingly engages said polished bore wall of said lower receptacle; and means on said inner tubing string and shoulder means formed on said outer tubing string and on said production tubing string for controlling vertical movement of said outer tubing string and said stinger seal unit during high-pressure temperature and density changes in said well.

2. Apparatus as recited in claim 1 in which upward movement of said outer tubing string is inhibited by one of said shoulder means on said outer tubing string engaging said means on said inner tubing string and downward movement of said outer tubing string is inhibited by engagement of another of said shoulder means on said outer tubing string engaging said shoulder means on said production tubing string.

3. A method for completing a well provided with a protective casing string extending from the earth's surface to a selected depth in the well bore comprising positioning a production casing string having an upper section and reduced-diameter lower section through said production casing string, the lower portion of said upper section being internally stepped to provide upper and lower polished bore receptacles, cementing said production casing string in place in said well bore;

displacing said cement from said production casing string with a drilling mud;

running an inner tubing string having upper and lower spaced-apart external fluted hangers into said production casing string;

circulating a packer fluid down said production casing string and up said inner tubing string to remove said drilling mud from said production casing string to a selected level whereby said production casing string above said level is full of packer fluid;

removing said inner tubing string from said well;

running an outer tubing string into said production string and, said outer tubing string having a reduced-diameter stinger section extending from its lower end, said stinger section being provided with an annular external seal unit and a second annular shoulder formed on the outer wall of said outer tubing string at the junction of the outer walls of said outer tubing string and said stinger section, a third annular shoulder being formed in the outer tubing string at the junction of the inner walls of the outer tubing string and the stinger section;

positioning said outer tubing string in said production casing string such that said seal unit on said stinger section sealingly engages said polished bore wall of said lower receptacle and said lower end of said stinger section is spaced a selected distance above said pre-selected level and said second annular shoulder is spaced a selected distance above said first annular shoulder;

running said inner tubing string into said second tubing string and seating said lower fluted hanger on said hanger seat member;

circulating drilling mud down said outer tubing string and up said inner tubing string to replace said packer fluid in said outer tubing string with said drilling mud;

removing said inner tubing string from said well;

lowering a perforator on a wire line into said production casing string adjacent a high-pressure formation;

actuating said perforator and perforating said formation;

removing said perforator from said well;

running a longer inner tubing string into said well and seating said lower fluted hanger on said hanger seat, the lower end of said longer inner tubing string extending in said production casing string to a level below said perforated formation and said upper fluted hangers spaced a selected distance above said third annular shoulder;

circulating a wash fluid down said outer tubing string and up said inner tubing string to remove drilling mud from said well to reduce the hydrostatic pressure in said well whereby fluids from said formation can flow into said production string;

continuing said circulation until only wash fluid and formation fluids appear at said surface; and producing said formation fluids through said inner tubing string while controlling movement of the stinger seal unit caused by high pressure temperature and density changes in said well.

4. Apparatus for completing a well in which a well bore is drilled from the earth's surface and is provided with a protective casing string extending from the earth's surface to a selected depth in said well bore, comprising:

a production casing string extending from said earth's surface through said protective casing string and having upper and lower sections, said lower section being of smaller diameter than said upper section and extending to total depth of said well bore;

the lower portion of said upper section being stepped to provide upper and lower polished bore receptacles, said upper receptacle having an internal bore of larger diameter than the bore of said lower receptacle forming thereby a first annular shoulder at the junction of said receptacle bores;

a support shoulder formed in the lower receptacle at the junction of said bore of said lower receptacle and the inner wall of said lower section;

a ring-shaped hanger seat member positioned on said support shoulder;

an outer tubing string positioned in said production casing string and having a reduced diameter stinger section extending from the lower end of said outer tubing string, said stinger section being provided with an annular external seal unit which sealingly engages said polished bore wall of said lower receptacle;

a second annular shoulder formed on the outer wall of said outer tubing string at the junction of the outer wall of said outer tubing string and said stinger section such that when said outer tubing string is positioned in said production casing string, the lower end of said stinger section is spaced a selected distance above said hanger seat member and said second annular shoulder is spaced a selected distance above said first annular shoulder;

a third annular shoulder formed in said outer tubing string at the junction of the inner walls of said outer tubing string and said stinger section;

an inner tubing string provided with upper and lower spaced-apart outer fluted hangers and extending from said earth's surface through said outer tubing string and said hanger seat member into said production casing string;

said inner tubing string being of smaller diameter than the inner diameter of said hanger seat member to allow fluid flow therebetween; and said inner tubing string being positioned such that said lower fluted hanger seats on said hanger seat member and said upper fluted hanger is spaced a selected distance above said third annular shoulder.

5. Apparatus as recited in claim 4 in which said spacing of said second annular shoulder above said first annular shoulder is less than said spacing of the lower end of said stinger section above said hanger seat member.

6. Apparatus as recited in claim 4 in which said seal unit is an integral part of said stingers section.

7. Apparatus as recited in claim 4 in which said seal unit is threadedly connected to said stinger section.

8. Apparatus as recited in claim 4 in which said seal unit is provided with an annular external groove containing bidirectionally arranged chevron-type seal rings.

9. A method for completing a well provided with a protective casing string extending from the earth's surface to a selected depth in the well bore comprising:

positioning a production casing string, having an upper section and a reduced diameter lower section, through said protective casing string to extend from said earth's surface to total depth of said well bore, the lower portion of said upper section being internally stepped to provide upper and lower polished bore receptacles, said upper receptacle having a bore of larger diameter than the bore of said lower receptacle forming a first annular shoulder at the junction of said bores, a support shoulder formed in said lower receptacle at the junction of said bore of said lower receptacle and the inner wall of said lower section;

cementing said production casing string in place in said well bore;

displacing said cement from said production casing string with a drilling mud;

positioning a ring-shaped hanger seat member in said lower receptacle on said support shoulder;

running an inner tubing string, having upper and lower spaced-apart external fluted hangers, into said production casing string and through said hanger seat member and seating said lower fluted hanger on said hanger seat member;

circulating packer fluid down said production casing string and up said inner tubing string to remove said drilling mud from said production casing string to a level below said hanger seat member, whereby said production casing string above said level is full of packer fluid;

removing said inner tubing string from said well;

running an outer tubing string into said production string, said outer tubing string having a reduced diameter stinger section extending from its lower end, said stinger section being provided with an annular external seal unit about its lower end and a second annular shoulder formed on the outer wall of said outer tubing string at the junction of the outer walls of said outer tubing string and said stinger section, a third annular shoulder being formed in said outer tubing string at the junction of the inner walls of said outer tubing string and said stringer section;

positioning said outer tubing string in said production casing string such that said seal unit on said stinger section sealingly engages said polished bore wall of said lower receptacle and said lower end of said stinger section is spaced a selected distance above said hanger seat member and said second annular shoulder is spaced a selected distance above said first annular shoulder;

running said inner tubing string into said second tubing string and seating said lower fluted hanger on said hanger seat member;

circulating drilling mud down said outer tubing string and up said inner tubing string to replace said packer fluid in said outer tubing string with said drilling mud;

removing said inner tubing string from said well;

lowering a perforator on a wire line into said production casing string adjacent a high pressure formation;

actuating said perforator and perforating said formation;

removing said perforator from said well;

running a longer inner tubing string into said well and seating said lower fluted hanger on said hanger seat, the lower end of said longer inner tubing string extending in said production casing string to a level below said perforated formation and said upper fluted hanger spaced a selected distance above said third annular shoulder;

circulating a wash fluid down said outer tubing string and up said inner tubing string to remove drilling mud from said well to reduce the hydrostatic pressure in said well whereby fluids from said formation can flow into said production string;

continuing said circulation until only wash fluid and formation fluids appear at said surface; and producing said formation fluids through said inner tubing string.

10. A method as recited in claim 9 in which well treating fluids are injected down said outer tubing string and produced along with formation fluids through said inner tubing string.

11. A method as recited in claim 9 wherein said seal unit becomes seized in said lower receptacle comprising the steps of:

circulating heavy mud into said production casing to offset said formation pressure;

removing said inner tubing string from said well;

rotating said outer tubing string to the right to release said stinger section from said seized seal unit;

removing said outer tubing string and said stinger from said well and connecting a new seal unit to said stinger;

running a back-up polished bore receptacle into said production casing string on a tubing work string, said back-up receptacle unit comprising an upper receptacle sleeve section and a lower tubular section provided on its lower periphery with an external annular seal unit, the bore of said tubular section being of smaller diameter than the bore of said upper sleeve section so as to form a back-up shoulder at their junction, a back-up ring-shaped hanger seat member is positioned on said back-up shoulder, said bore of said receptacle sleeve being of the same diameter as said lower receptacle, and a latch slip assembly being provided about the exterior of said back-up receptacle unit;

positioning said back-up receptacle unit in said production casing such that back-up seal unit seats on said first annualar shoulder in said upper receptacle and sealingly engages the bore wall of said upper receptacle, and said receptacle sleeve section extending upwardly above said upper receptacle;

latching said back-up receptacle unit in position;

lowering said outer tubing string and stinger section provided with said new seal unit into said production casing string and positioning said lower end of said stinger section just above the upper end of said back-up receptacle sleeve;

running said inner tubing string through said outer tubing string and into said receptacle unit to a level such that its lower is positioned below said back-up hanger seat member;

circulating packer fluid down said outer tubing string and up said inner tubing string to remove mud to said level below said back-up hanger seat;

lowering said outer tubing string and positioning said new seal unit in said bore of said receptacle sleeve;

lowering said inner tubing string so as to seat said lower fluted hanger on said back-up hanger seat and said upper fluted hanger is being spaced a selected distanced above said third annular shoulder;

circulating a wash fluid down around said inner tubing string and up said inner tubing string to remove mud from said production casing string and said outer tubing string; and producing formation fluids through said inner tubing string.

* * * * *